United States Patent [19]

Rasnick et al.

[11] Patent Number: 4,803,742

[45] Date of Patent: Feb. 14, 1989

[54] CONVERTIBLE BED

[75] Inventors: Glen L. Rasnick, Siler City, N.C.; Albert R. St. Clair, Lilburn, Ga.

[73] Assignee: Simmons U.S.A. Corporation, Atlanta, Ga.

[21] Appl. No.: 872,338

[22] Filed: Jun. 9, 1986

[51] Int. Cl.[4] ..... A47C 17/04

[52] U.S. Cl. ..... 5/18 R; 5/37 R; 5/37 C; 5/41

[58] Field of Search ..... 5/18 R, 20, 17, 57 C, 5/37 R, 37 C, 41

[56] References Cited

U.S. PATENT DOCUMENTS

| | | | |
|---|---|---|---|
| 2,568,366 | 9/1951 | Rosen | 5/18 R |
| 2,853,717 | 9/1958 | Firsel | 5/17 |
| 3,019,454 | 2/1962 | Luca | 5/17 |
| 3,064,276 | 11/1962 | Newsom III | 5/17 |
| 3,925,834 | 12/1975 | Johnson et al. | 5/17 X |
| 4,031,577 | 6/1977 | Kanowsky et al. | 5/17 |
| 4,086,671 | 5/1978 | Lane | 5/18 R |
| 4,204,287 | 5/1980 | Lane et al. | 5/18 R |
| 4,402,096 | 9/1983 | Atimichuk | 5/17 |
| 4,586,206 | 5/1986 | Singer | 5/18 R |

FOREIGN PATENT DOCUMENTS

| | | | |
|---|---|---|---|
| 171756 | 7/1952 | Fed. Rep. of Germany | 5/18 R |
| 200618 | 1/1939 | Switzerland | 5/18 |
| 338868 | 11/1930 | United Kingdom | 5/17 |
| 669513 | 4/1952 | United Kingdom | 5/18 R |

*Primary Examiner*—Michael F. Trettel

*Attorney, Agent, or Firm*—Jones, Askew & Lunsford

[57] ABSTRACT

A convertible bed assembly is provided which is movable between a seating position and a bed position. The assembly includes foot, intermediate and head support sections, the latter being fixedly mounted to a frame assembly. The three sections are arranged in telescoping relation such that all may fit within the frame assembly. The foot and intermediate sections are both pivotably mounted with respect to the frame assembly. An inclined or curved rear wall is provided to urge a mattress supported by the sections downwardly as it is moved in the direction of the head support section. As the mattress moves in this direction, it is folded into a seating position including a seat portion and a back portion.

26 Claims, 5 Drawing Sheets

CONVERTIBLE BED

BACKGROUND OF THE INVENTION

1. Field of the invention.

The field of the invention relates to convertible bed structures.

2. Background of the invention.

Convertible beds in use today typically employ linkage mechanisms which allow them to convert from sofas to beds. U.S. Pat. Nos. 3,047,886, 3,516,096, and 4,048,680 disclose sofa beds of this type.

A less common construction has no linkage mechanism and instead employs three pivotably connected support sections capable of defining an entirely flat surface or one having a seat and a back. In this construction, a mattress mounted thereon is folded between seating and reclining positions as the support sections are adjusted.

SUMMARY OF THE INVENTION

The present invention is directed to a sofa sleeper construction including a plurality of telescoping portions which allow a mattress supported thereon to be folded between a horizontal (bed) position and a folded position wherein it assumes the contours of a sofa. The construction preferable includes foot, middle and head portions. A mattress including an innerspring construction as disclosed in U.S. Pat. No. 4,234,984 may be utilized in conjunction with the invention as it is easily folded to the desired position.

In a preferred embodiment of the invention, the middle portion of the construction telescopes within the foot portion. The foot portion in turn telescopes within the head portion. The head portion is supported by a frame which is normally upholstered. The frame includes a rear wall positioned a selected distance from the rear end of the head portion, thereby defining a gap therebetween. The rear wall is preferably inclined or curved to urge the mattress downwardly as the portions telescope within each other.

DETAILED DESCRIPTION OF THE INVENTION

A convertible bed construction 10 is provided which includes foot, middle and head sections 12, 14, 16. The head section 16 is mounted to a frame 18 so that it remains in a fixed position with respect thereto.

Figure 1:
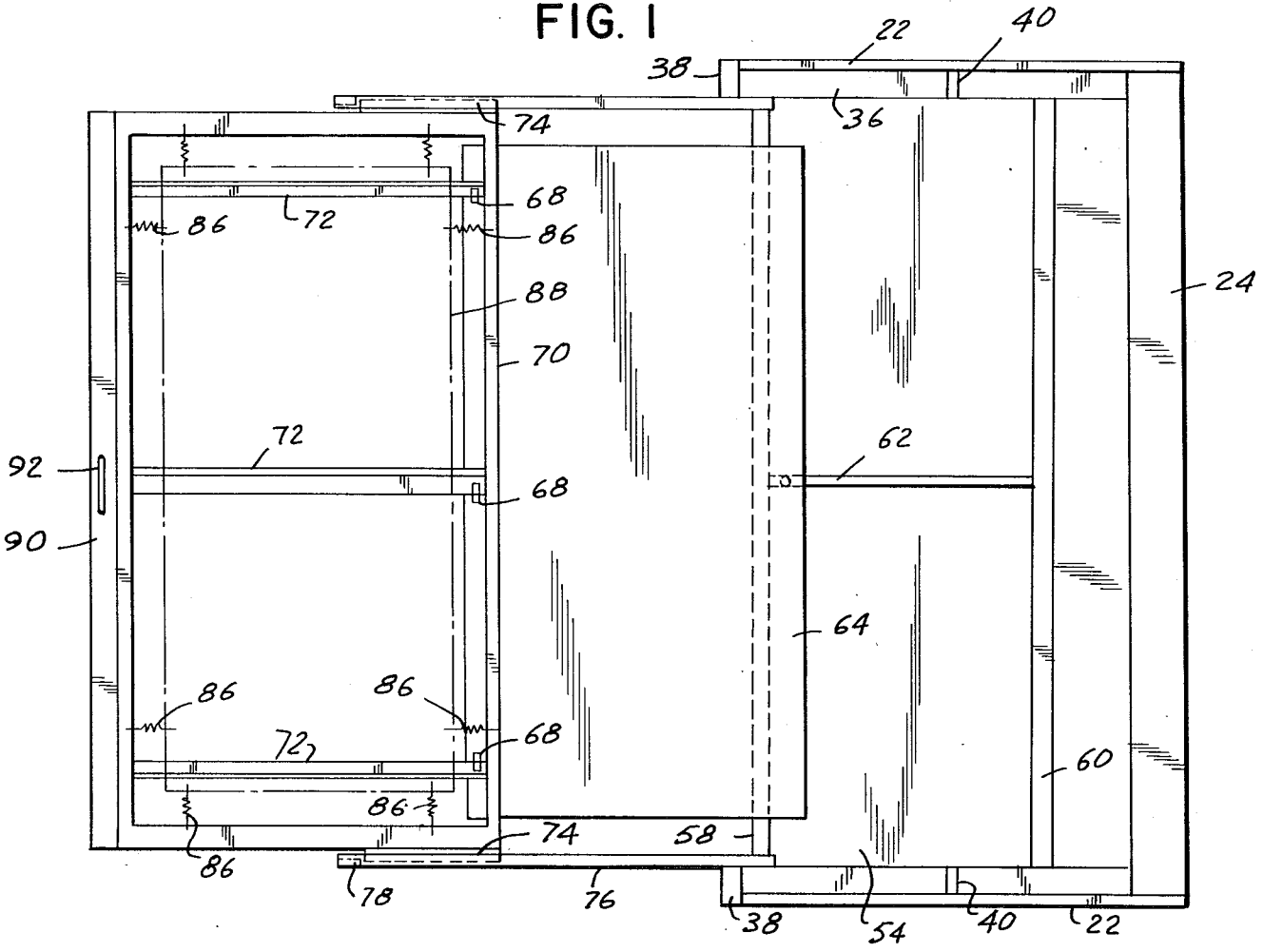
FIG. 1 is a top plan view of a convertible bed construction according to the invention in a fully extended position.
Figure 2:
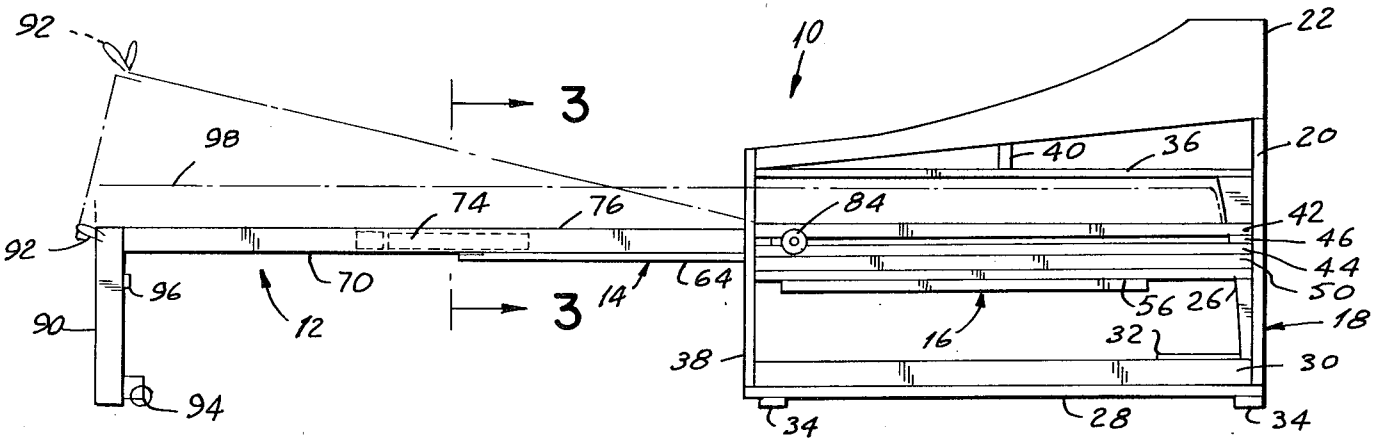
FIG. 2 is a side elevation view thereof.
Figure 3:
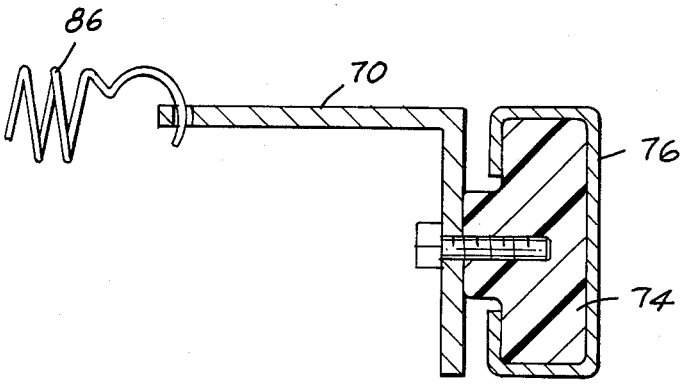
FIG. 3 is a sectional view taken along the plane of line 3—3 in FIG. 2.
Figure 4:
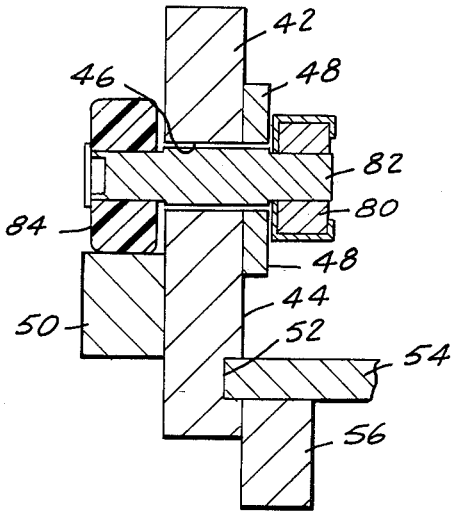
FIG. 4 is a sectional view illustrating the connection of the foot portion of the invention with the frame thereof.

Referring to FIGS. 1, 2 and 4, the frame 18 includes a pair of rear, vertical support members 20, a pair of top side panels 22 which fit within respective notches of members 20, a top cross member 24 connecting the top side panels 22, and an inclined or curved rear wall 26 supported by the rear support members 20. The frame is basically made from wood while the curved rear wall is preferably made from a smoother material such as Masonite.

The bottom of the frame includes two pairs of elongate members 28,30, one pair 30 of which is mounted on edge. A support member 32 extends between members 30 near the base of the curved wall 26. Base blocks 34 are provided near each end of the elongate members 28 and normally rest upon the floor.

A pair of horizontally mounted side members 36 extends between the rear vertical support members 20 and respective front panels 38. The front panels define the front arm portions of the frame 18 and are notched at the inside bottom portions to receive the front ends of members 30. Support braces 40 connect the top side panels 22 with side members 36.

A series of parallel members extend between the rear vertical support members 20 and the front panels 38. Members 42 and 44 are both edge-mounted as shown in FIGS. 2 and 4 and define a slot 46 therebetween. The front ends thereof are positioned within respective, opposing notches (not shown) defined in the front panels 38. The rear ends are secured to members 20. A pair of elongate members 48 are secured near the respective bottom and top portions of members 42 and 44. The opposing faces of these members 48 extend the length of the slot 46.

An elongate member 50 is secured to the outer surface of each lower member 44. The upper surface of member 50 is positioned parallel to and beneath the lower surface defining the slot 46.

Opposing slots 52 are provided within the inner surfaces of members 44 to receive a panel 54 made from Masonite, plywood, or other material of suitable strength for supporting persons seated on a sofa bed. Support members 56 are secured to members 44 beneath the slots 52 to p[rovide additional support.

The frame panel 54 is secured to a wood cross member 58 at its front end and a second cross member 60 at its rear end. Both cross members 58, 60 are secured to members 44. A longitudinal slot 62 extends between the cross members. The slot is defined by the inner edges of two adjacent panel portions which together comprise the panel or head section 16 of the bed construction 10.

The middle portion 14 of the construction includes a panel 64 similar to the one mounted to the frame 18. A pin 66 is secured to the bottom surface thereof. The pin is positioned near the rear end of the panel 64 and extends within slot 62.

Figure 8:
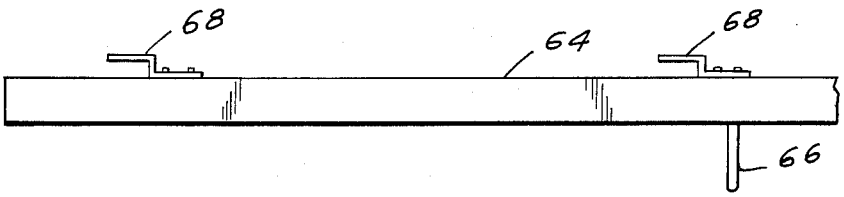
FIG. 8 is a partial end view of the middle portion of the invention.

A plurality of s-shaped brackets 68 are mounted to the top side of panel 64 near the front end thereof. Two of such brackets are shown in FIG. 8. The third bracket shown in FIG. 1 is identical to the first two but faces in the opposite direction.

The foot section 12 of the bed construction includes a substantially rectangular angle iron frame 70 having a plurality of longitudinal angle iron braces 72. Two of the braces face in the same direction while the third faces in an opposite direction. This enables the brackets 68 to secure the middle panel 64 beneath the frame 70.

A hat-shaped slide bearing 74 is bolted to each side of the frame 70 near the rear end thereof. The bearings are each about nine inches long and are made from a material which slides easily along a metal surface. Ultra-high molecular weight polyethylene has been found to have sufficient strength and slidability for this purpose.

A C-shaped slide channel 76 is mounted to each slide bearing and is slidable with respect thereto. The front end of the slide channel includes a stop member 78 which contacts the bearing 74 when in the fully extending position shown in FIGS. 1–2. The rear end thereof includes a second stop member 80 which supports an axle 82 and wheel 84. The axles 82 extend respectively through slots 46 while the wheels 84 rest upon the upper surfaces of members 50.

A plurality of coil springs 86 are mounted to the angle iron frame 70 for supporting a fabric or wire mesh grid 88 shown in phantom in the drawings. Such grids are well known in the art.

A front board 90 is bolted to the front end of frame 70. The board supports the end of the bed construction. A strap 92 secured to the top of the board 90 allows the foot and intermediate portions of the bed construction to be pulled away from the frame 18 by the user. These two portions are pivotable about the axis running through the wheels 84 as shown in phantom in FIG. 2. This allows a person to pull the foot and intermediate portions out without fully bending over. A set of wheels 94 mounted near the bottom of the board 90 allows it to move easily along the floor while being pushed in. A latch 96 is provided on the inner surface of the board. The latch secures the board to cross member 58 when the construction is in the closed position shown in FIG. 7. The latch is released when the user pulls up the front board.

In use, the two panels 54, 64 and the grid 88 support a mattress 98 having sufficient flexibility to be folded into the contour of a sofa seat and back. Mattresses having innersprings made from rows of pocketed coil springs have been found to be suitable for this purpose.

The bed construction 10 is shown in the open or extended position in FIGS. 1–2 whereby it may be employed as a bed. The slide channels 76 are fully extended with respect to the angle iron frame 70 and the wheels 84 secured thereto are located at the front end of the slot 46. Only a small end portion of the intermediate panel 64 is positioned beneath the angle iron frame 70 and its opposite end barely overlaps the frame panel 54.

Figure 5:
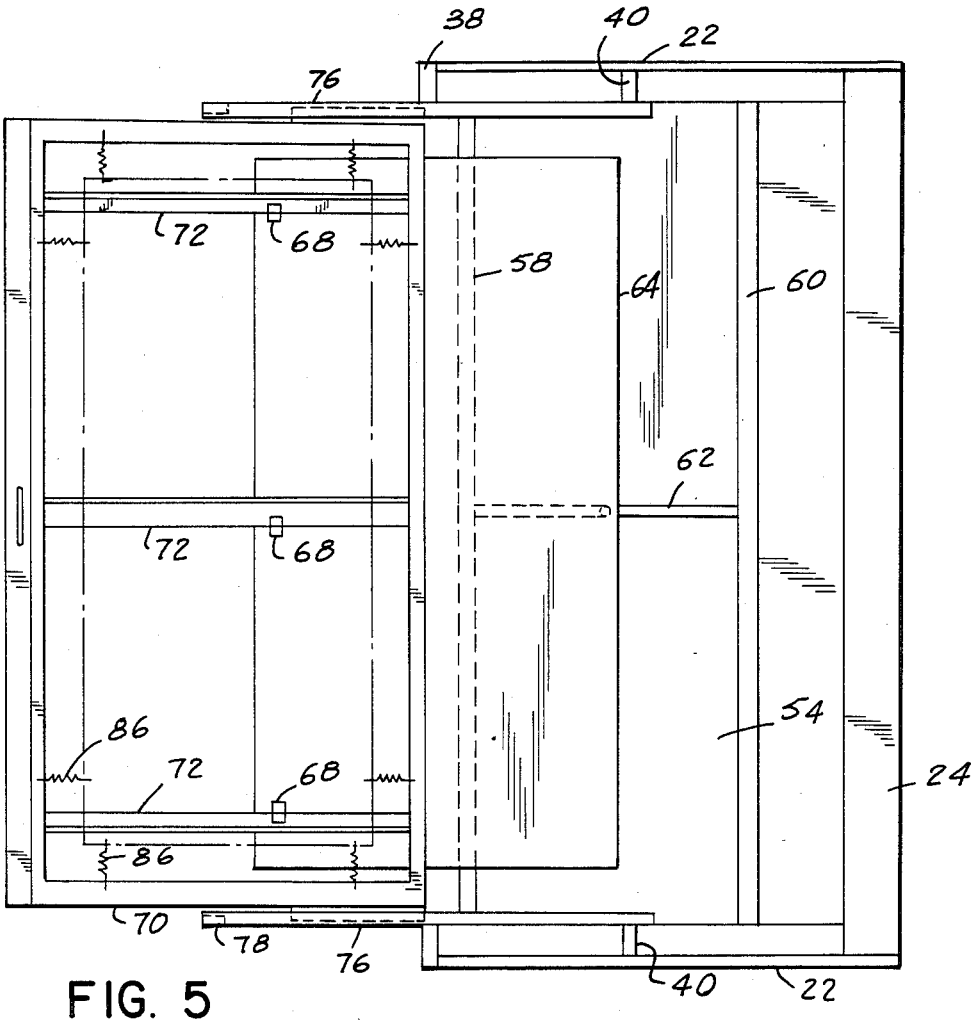
FIG. 5 is a top plan view of the construction shown in a partially closed position.
Figure 6:
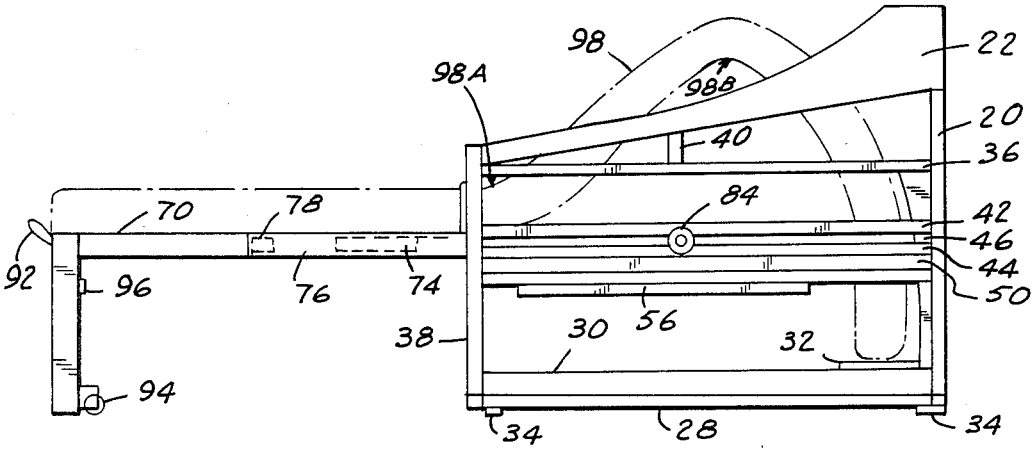
FIG. 6 is a side elevation view of the construction shown in FIG. 5.
Figure 7:
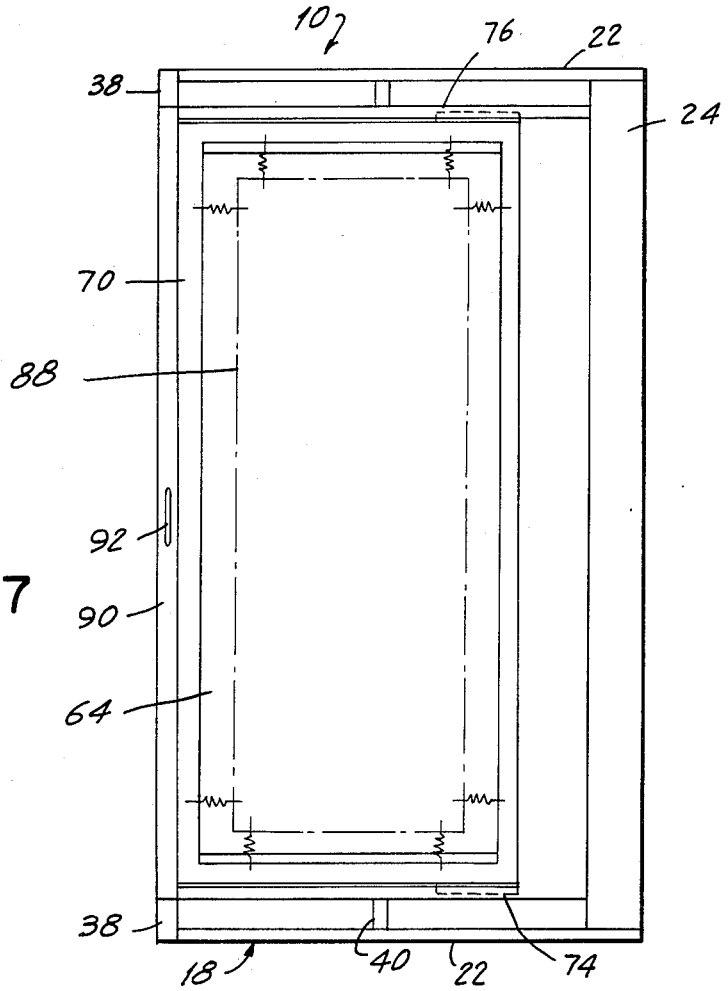
FIG. 7 is a top plan view of the construction in the fully closed position.

When one desires to move the construction into the closed position shown in FIG. 7 whereby it may be employed as a sofa, an inward force is exerted upon the front board 90. The foot and intermediate sections 12, 14, being conveniently pivotable about the axis passing through wheels 84, may be moved towards the frame 18 without excessive bending by using the strap 92 to lift the board 90. When inward movement begins, the head end of the mattress 98 contacts the curved rear wall 26 which directs it downwardly towards the support member 32. Sufficient space is provided between the cross member 60 and this wall to allow such movement. The wall 26 is substantially the same width as the frame panel 54 and the mattress employed thereon. As the downward movement occurs, the mattress forms an upwardly extending loop as shown in FIG. 6. Although relative movement of the foot and intermediate sections of the bed construction is not controlled, there will tend to be some movement of both during the opening and closing thereof. FIG. 5 shows the intermediate panel 64 as extending further under the angle iron frame 70 and overlapping more of the frame panel 54 then is shown in FIG. 1. The slide channels 76 have also retracted towards the frame 70, the wheels 84 thereof being positioned nearer the midpoint of the slot 46 as shown in FIG. 6.

FIG. 7 shows the construction 10 (without the mattress) in the fully closed position. The intermediate panel 64, having been guided by the pin 66 moving within the panel slot 62, is positioned entirely within the main frame 18. The angle iron frame 70, having slided over the intermediate panel 64 as the angle iron braces 72 move within the panel brackets 68, is also positioned within the main frame 18. The latch 96 on the front board 90 latches to a complementary locking structure (not shown) on the cross members 58 to insure against the construction involuntarily reopening. The wheels 84 on the slide channels are positioned near the rear end of the slot 46 when in this position.

The mattress 98 defines the seat and back of a sofa when the sections 12, 14, 16 are positioned as shown in FIG. 7. The first mattress fold 98A shown in FIG. 6 would be about ninety degrees while the second fold 98B would close almost entirely. The head end of the mattress is supported by member 32.

It will be understood that substantially the entire frame 18, including the front board 90, is upholstered. The mechanisms by which the construction operates are accordingly normally hidden from view.

In addition to the advantages associated with the absence of complex mechanisms and many moving parts, the invention makes use of gravity during the closing operation rather than working against it as conventional sofa sleepers do. By using a curved or inclined rear wall to urge the head end of the mattress down, the weight thereof starts pulling the remainder of the mattress towards the frame 18. The process is analogous to that of pushing a mattress off a table. The weight of the mattress moving down makes it far easier to push the rest of the mattress off the table. The telescoping foot, intermediate and head sections of the bed construction simply follow the movement of the mattress.

We claim:

1. A convertible bed assembly comprising:

a one piece mattress means having a headward and a footward end;

a frame assembly, said frame assembly including a front end, a rear end, and a first section having a first support surface that supports at least part of said mattress means;

means for urging said mattress means positioned on said frame assembly along a predetermined path such that the headward end of said mattress means moves downwardly and below said first support surface, and the footward end of said mattress means moves rearwardly over said first support surface; and mattress end supporting means located below said first support surface for stopping travel of said mattress means proximate said end at a predetermined point along said predetermined path such that an intermediate portion of said mattress means bows upwardly and out of said predetermined path.

2. A convertible bed assembly as defined in claim 1 wherein said urging means includes a rear member having an inclined surface positioned rearwardly of said first support surface, said rear member being mounted to said frame assembly and positioned a selected distance from said first support surface whereby said mattress means may move downwardly between said rear member and the rear end of said first section.

3. A convertible bed assembly as defined in claim 2 wherein said inclined surface is part of a curved surface upon said rear member.

4. A convertible bed assembly as defined in claim 2 including a second section defining a second support surface, means for mounting said second section to said frame assembly such that it may be moved within said frame assembly or out the front end thereof, one of said first and second support surfaces at least partially overlapping the other when said second section is positioned within said frame assembly.

5. A convertible bed assembly as defined in claim 4 including a means for pivotably mounting said second section to said frame assembly.

6. A convertible bed assembly as defined in claim 4 including a third section defining a third support surface, means for mounting said third section to said frame assembly such that it may be moved within said frame assembly or out the front end thereof, said first, second and third support surfaces being in an overlapping position with respect to each other when positioned within said frame assembly.

7. A convertible bed assembly as defined in claim 6 including means for pivotably mounting said second and third sections with respect to said frame assembly.

8. A convertible bed assembly as defined in claim 6 wherein said third section includes a substantially rectangular frame, first and second arms slidably mounted to opposite sides of said substantially rectangular frame, and a wheel mounted near one end of each of said arms, each of said wheels being supported by said frame assembly.

9. A convertible bed assembly as defined in claim 8 wherein said second section is slidably mounted to said substantially rectangular frame.

10. A convertible bed assembly as defined in claim 9 wherein said second section is slidably mounted to said first section.

11. A convertible bed assembly as defined in claim 8 wherein said frame assembly includes first and second longitudinal members extending horizontally between said front and rear ends thereof, said wheels being respectively supported by said first and second longitudinal members and capable of rolling thereon.

12. A convertible bed assembly as defined in claim 8 including a front board mounted to one end of said substantially rectangular frame, said front board including a latch for locking it to said frame assembly.

13. A convertible bed assembly as defined in claim 2 wherein said frame assembly includes a base portion, said first support surface being substantially horizontal and mounted a selected distance above said base portion, and at least part of said inclined surface extending higher than said first support surface.

14. A convertible bed assembly as defined in claim 13 wherein said rear member is a rear wall positioned said selected distance behind said first section and extending above and below said first support surface, said first support surface being defined by a substantially rectangular panel of selected length and width, said inclined surface having substantially the same width as said substantially rectangular panel.

15. A convertible bed assembly comprising:

a one piece mattress means including a headward and a footward end;

means for supporting said mattress means in a first reclining position such that said mattress means is substantially horizontal;

a mattress means end supporting member; and means for urging said mattress means from said first position along a predetermined path such that said headward end of said mattress means encounters said mattress means end supporting member and is urged against said mattress means end supporting member, such that said mattress means bows upwardly out of said predetermined path intermediate its headward and footward ends, and said mattress means assumes a second sitting position with a portion of said mattress means being inclined from horizontal.

16. A convertible bed assembly as claimed in claim 15, wherein said mattress end supporting member comprises an elongate member having a longitudinal axis, said elongate member being positioned in the path of said headward end of said mattress means such that said longitudinal axis is substantially perpendicular to the path of travel of said mattress means end.

17. A convertible bed assembly as claimed in claim 16, further comprises means for urging said mattress means downwardly comprising a wall defining an inclined surface, said inclined surface being positioned in said path of travel such that said mattress means end contacts said inclined surface and slidably follows a portion of said inclined surface toward said mattress means end supporting member.

18. A convertible bed assembly as claimed in claim 17, wherein said inclined surface is part of a curved surface defined by said wall.

19. A convertible bed assembly as claimed in claim 15, further comprises means for urging said mattress means end downwardly comprising a wall defining an inclined surface, said inclined surface being positioned in said path of travel such that said mattress end contacts said inclined surface and slidably follows a portion of said inclined surface toward said mattress means end supporting member.

20. A convertible bed assembly as claimed in claim 19, wherein said inclined surface is part of a curved surface defined by said wall.

21. A convertible bed assembly comprising:

a one piece mattress means including a headward and a footward end and a headward, middle, and a footward section;

means for supporting said mattress means in a first reclining position such that said headward, middle, and footward sections of said mattress means are substantially horizontal;

a mattress means end supporting member;

means for urging said mattress means from said first position along a predetermined path such that said headward end of said mattress means encounters said mattress means end supporting member and is urged against said mattress means end supporting member, such that said mattress bows upwardly out of said predetermined path along the intersection of said headward and middle sections, and said mattress means assumes a second sitting position with said headward and said middle sections being inclined from horizontal.

22. A convertible bed assembly as claimed in claim 21, wherein said mattress means end supporting member comprises an elongate member having a longitudinal axis, said elongate member being positioned in the path of said headward end of said mattress means such that said longitudinal axis is substantially perpendicular to the path of travel of said mattress means end.

23. A convertible bed assembly as claimed in claim 22, further comprises means for urging said mattress means end downwardly comprising a wall defining an inclined surface, said inclined surface being positioned in said path of travel such that said mattress means end contacts said inclined surface and slidably follows a portion of said inclined surface toward said mattress means end supporting member.

24. A convertible bed assembly as claimed in claim 23, wherein said inclined surface is part of a curved surface defined by said wall.

25. A convertible bed assembly as claimed in claim 21, further comprises means for urging said mattress means end downwardly comprising a wall defining an inclined surface, said inclined surface being positioned in said path of travel such that said mattress means end contacts said inclined surface and slidably follows a portion of said inclined surface toward said mattress means end supporting member.

26. A convertible bed assembly as claimed in claim 25, wherein said inclined surface is part of a curved surface defined by said wall.

* * * * *